US005372779A

United States Patent [19]

Reti

[11] Patent Number: 5,372,779

[45] Date of Patent: Dec. 13, 1994

[54] NICKEL-FREE WHITE GOLD ALLOYS

[75] Inventor: Aldo M. Reti, Milford, Conn.

[73] Assignee: Handy & Harman, New York, N.Y.

[21] Appl. No.: 60,601

[22] Filed: May 12, 1993

[51] Int. Cl.[5] ..... C22C 5/06; C22C 5/02

[52] U.S. Cl. ..... 420/505; 420/508; 420/511; 420/580; 148/430; 148/442

[58] Field of Search ..... 420/505, 508, 511, 580; 148/430, 442; C22C 5/02, 5/08, 30/06

[56] References Cited

U.S. PATENT DOCUMENTS 5,240,172 8/1993 Steinke et al. ..... 228/262.61

FOREIGN PATENT DOCUMENTS 58-210132 12/1983 Japan ..... 420/505

OTHER PUBLICATIONS

W. S. Rapson and T. Groenewald, "Gold Usage", Academic Press, 1978, p. 48.

A. S. McDonald and G. H. Sistare, "The Metallurgy of Some Carat Gold Jewelry Alloys", *Gold Bulletin,* 1978, vol. 4, No. p. 128.

"Focus: The Nickel Controversy in Europe", MJSA Publication, vol. 4, No. 9, Sep. 1992.

"Nickel and Nickel Alloy Articles that come in contact with the skin", released by the Nickel Development Institute, Jul. 1992.

G. Normandeau, "White Golds: A Review of Commercial Material Characteristics and Alloy Design Alternatives", *Gold Bulletin* 1992, vol. 25 (3), p. 94.

G. P. O'Connor, "Improvement of 18 Carat White Gold Alloys", *Gold Bulletin,* 1978, vol. 11, (2), p. 35.

I. B. MacCormack and J. E. Bowers, "New White Gold Alloys", *Gold Bulletin,* 1981, vol. 14, (1), p. 19.

C. Liden, "Some Aspects on Contact Allergy to Nickel", presented at the First Meeting of CEN/TC 283 precious Metals, Milan, 15–16 Jul. 1991.

D. P. Agarwal and G. Raykhtsaum, "Color Technology for Jewelry Alloy Applications", Proceedings of the Santa Fe Symposium on Jewelry Manufacturing Technology, 1988, MetChem Research Inc., 1989, p. 229.

"Standard Test Method for Calculation of Color Differences From Instrumentally Measured Color Coordinates", ASTM Standard D2244–89, Annual Book of ASTM Standards, vol. 06.01.

J. J. Tuccillo and J. P. Nielsen, *J. of Prosthetic Dentistry,* vol. 25, p. 629, 1971.

*Primary Examiner*—Richard O. Dean
*Assistant Examiner*—Sean Vincent
*Attorney, Agent, or Firm*—Pennie & Edmonds

[57] ABSTRACT

A white gold alloy composition consisting essentially of about 35 to 50 weight percent of gold, about 35 to 63 weight percent of silver, about 0.1 to 7 weight percent of a whitening component of zinc, germanium or both, and palladium in an amount of about 9 weight percent or less. The whitening component and the palladium are present in an amount sufficient to impart a white gold appearance and a liquidus temperature of no greater than about 1950° F. to the alloy, preferably between about 1700° and 1900° F., and more preferably less than about 1850° F. Thus, the preferred amount of palladium is about 2 to 5 weight percent and the preferred amount of the whitening component is about 0.5 to 6 weight percent.

20 Claims, 10 Drawing Sheets

NICKEL-FREE WHITE GOLD ALLOYS

TECHNICAL FIELD

The present invention relates to substantially nickel-free white gold alloys for use in jewelry applications.

BACKGROUND ART

There are currently in existence many commercial white karat gold compositions that have proven successful. Palladium is known to be an effective whitener of gold alloys derived from the Au/Pd/Ag system, and such alloys exhibit excellent workability and low hardness (see W. S. Rapson and T. Groenewald, "Gold Usage", Academic Press, 1978, p. 48). The drawbacks of these type alloys are their high cost and high melting temperatures due to their relatively high palladium content, with the high melting temperatures being an inconvenience for investment casters.

Nickel is also an excellent whitener of gold and, when also combined with copper, results in alloys having good mechanical properties, workability and casting characteristics (see A. S. McDonald and G. H. Sistare, "The Metallurgy of Some Carat Gold Jewelry Alloys", *Gold Bulletin,* 1978, Vol. 4, No. 4, p. 128). Nickel has been identified as allergenic, however, and its use in jewelry is currently regulated. Nickel in close contact with skin can cause nickel dermatitis, an allergic reaction. European studies have shown that about 10 % of the female population, predominantly those between the ages of 14 and 24, have a sensitivity to nickel (see "Focus: The Nickel Controversy in Europe", MJSA Publication, Vol. 4, No. 9, Sep. 1992). Among males, about 2% of the population is affected; this figure is expected to increase because increasing numbers of males are now having their ears pierced to wear earrings.

According to the Nickel Development Institute (see "Nickel and Nickel Alloy Articles That Come in Contact With the Skin", released by the Nickel Development Institute, July 1992), nickel in metallic form is not a sensitizing substance. Rather, sensitization and subsequent dermatitis are the result of a soluble corrosion product that occurs from the reaction of nickel with sweat that penetrates the skin. Accordingly, nickel-containing alloys that do not react with sweat will not cause dermatitis. For example, some stainless steels are non-allergenic, and it is most likely that a high karat gold alloy containing nickel will not react with sweat as well.

Also, transient contact with nickel is not harmful because there is insufficient time for a reaction with sweat. Thus, people can handle nickel-containing articles such as coins, tools, kitchenware, keys, etc. without experiencing nickel dermatitis. Sensitization can occur, however, when a significant exposure to nickel in soluble form takes place. Some dermatologists attribute the initial sensitization to the ear-piercing process, i.e., when a temporary stud that contains nickel is used during epithelization (the process of healing the wound). Here, nickel corrosion products can be present for a long time in the open wound and can cause sensitization.

Whether or not nickel containing materials are allergenic to individuals can be assessed through studies, now in progress in Europe, that involve Clinical Skin Patch Testing. In these tests, a patch containing the substance to be studied is directly applied on the skin for a certain time period. There are also tests, such as immersion in a synthetic perspiration solution, that are prescribed to determine the release of nickel. Preliminary information shows that surgical grade stainless steel (18-8) and high karat (18 Kt) nickel containing white golds appear to be nonallergenic, while brasses containing nickel and low karat (9-14 Kt) nickel containing white golds appear to cause an allergic reaction.

Thus, legislation in Europe is pending regarding articles such as earrings, bracelets, necklaces, rings, watch straps, etc. that come in direct and prolonged contact with the skin. For example, Denmark, since June 1989, has banned the sale of jewelry items that release nickel at a rate exceeding 0.5 micrograms per square centimeter per week. Germany prohibits the use of nickel on ear posts and, as of July 1993, requires a written warning label in articles that come in direct contact with the skin and release more than the above-stated amount. Sweden has set a limit of 0.05% nickel in alloys used for ear jewelry. Also, the European Community is working towards a common legislation on the nickel issue. Thus, there is a need to formulate compositions of white gold alloys that are essentially free of nickel.

SUMMARY OF THE INVENTION

Accordingly, the present invention relates to a white gold alloy composition consisting essentially of about 35 to 50 weight percent of gold, about 35 to 63 weight percent of silver, about 0.1 to 7 weight percent of a whitening component of zinc, germanium or both, and palladium in an amount of about 9 weight percent or less, preferably 5.5 weight percent or less. The whitening component and the palladium are present in an amount sufficient to impart a white gold appearance and a liquidus temperature of no greater than about 1950° F. to the alloy.

In these compositions, the whitening component and the palladium are present in an amount sufficient to impart a liquidus temperature which is preferably between about 1700° and 1900° F. to the alloy, and more preferably less than about 1850° F. Thus, the preferred amount palladium is about 2 to 7 weight percent. A preferred maximum amount of palladium is about 5 weight percent. The preferred amount of the whitening component is about 0.5 to 6 weight percent. In addition, these compositions are substantially free from nickel.

BRIEF DESCRIPTION OF THE DRAWINGS

FIGS. 1 through 5 are graphical illustrations of the effects of palladium, copper, zinc, germanium and iron, respectively, on color, liquidus temperature, hardness and workability of various 10 karat gold alloys.

DETAILED DESCRIPTION OF THE INVENTION

Figure 1A:
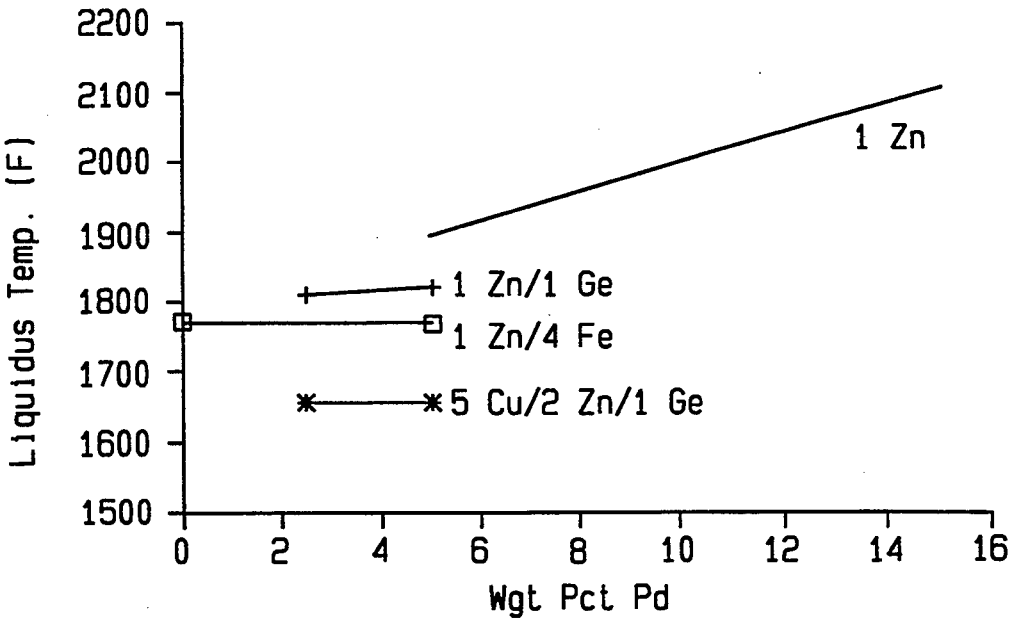
FIGS. 1A, 1B, 1C and 1D illustrate the effect of palladium additions on the above-mentioned properties of 10 karat gold alloys.

The objective of the present invention is to formulate substantially nickel-free and non-allergenic white gold alloys, preferably of the low karat (i.e., 10-14 Kt) types, that meet certain important characteristics required by the jewelry trade, such as:

good white color
reasonable low casting temperature
good workability
adequate hardness (not too soft)
good corrosion resistance (resist tarnishing)
an affordable cost.

The bleaching effect of various elements on the color of gold was investigated before arriving at the present combinations. Many potential whiteners of gold were excluded due to their high cost, because they would significantly increase the melting point of the alloy, because they embrittle the alloy through the formation of intermetallic compounds, or because they are known to be allergenic.

It was found that the addition of zinc and/or germanium to a gold-silver alloy that contains a small amount of palladium achieved desirable alloy formulations. The palladium additions were limited to only a few percent because of cost considerations and because higher palladium contents would unacceptably increase the melting point. Zinc and germanium additions were found to be very effective up to about 4%.

The amount of gold in the alloy ranges from about 35 to 50 weight percent, preferably about 38 to 45 weight percent, and more particularly about 40 to 43 weight percent, since that is the amount which is approximately the same as is used in conventional white gold alloys that contain nickel.

The amount of silver is generally about 35 to 63 weight percent, preferably about 46 to 60 weight percent, and more preferably about 50 to 55 weight percent. A relatively large amount of silver is used because it contributes to the whiteness of the alloy.

For further whitening of the alloy, about 0.1 to 7 weight percent of a whitening component is added. This component may be zinc, germanium or both, and is added in a preferred amount of about 0.5 to 6 weight percent. A specifically preferred whitening agent in equal amounts of both zinc and germanium, preferably at about 0.5 to 2.5 weight percent each.

Palladium is also added in an amount of about 9 weight percent or less. The preferred amount of palladium is about 2 to 7 weight percent, and more preferably, between about 2 and 5 weight percent.

Advantageously, the whitening component and the palladium are present in an amount sufficient to impart a white gold appearance and a liquidus temperature of no greater than about 1950° F. to the alloy. Use of the preferred amounts of these components imparts a liquidus temperature of between about 1700° and 1900° F. to the alloy, and typically less than about 1850° F. As shown below, certain alloys will have even lower liquidus temperatures.

Additional alloying elements can be included provided that they do not affect the basic characteristics of the present invention. Specifically, copper in an amount of up to about 12 weight percent and iron in an amount of up to about 8 weight percent can be included without detrimentally affecting these alloys.

EXAMPLES

Experimental alloys were formulated with the following criteria:

a gold content fixed at 41.7 %, the percentage of gold in a 10 Kt alloy.
a palladium content of 9% or less to maintain the liquidus temperature and costs reasonably low.
copper, zinc and germanium contents, alone or in combination, up to a level at which workability or color is not appreciably affected.
silver making up the balance of the alloy.

Each formulation weighed 155 grams. Melting by electric induction took place in a graphite crucible. When all ingredients were alloyed, the melts were solidified inside the crucible while a chromel-alumei thermocouple registered a time/temperature graph from which the liquidus and solidus temperatures were extracted. Then, each alloy was reheated to about 200° F. above the liquidus temperature and rapidly cast into a $\frac{1}{2}'' \times 1'' \times 1\frac{1}{2}''$ graphite mold. Hardness readings, per the Rockwell B Scale, were obtained from each casting. To evaluate workability, the castings were rolled, without anneals, until some form of cracking occurred; thus workability was reported as permissible percent reduction from the cast state.

The color of the various alloys was measured on coupons with 600 grit paper finish using a Macbeth 1500 Spectrophotometer and D65 Standard Daylight Illuminant source (see D. P. Agarwal and G. Raykhtsaum, "Color Technology for Jewelry Alloy Applications", Proceedings of the Santa Fe Symposium on Jewelry Manufacturing Technology, 1988, Met-Chem Research Inc., 1989, p. 229). In addition, the color of other white metals were measured as a comparison to avoid using imprecise terminology such as "silver-white", "platinum-white", "steel-white" etc These additional metals were samples of silver, platinum, palladium, rhodium, aluminum, nickel and 430 stainless steel, as well as commercially available 10, 14, and 18 Kt gold alloys containing nickel and a 10 Kt gold alloy containing 10% palladium.

Conventional CIELAB color coordinates, namely L*, a* and b*, were obtained in each color measurement. For simplicity, the approach suggested by I. B. MacCormack and J. E. Bowers, "New White Gold Alloys", *Gold Bulletin,* 1981, Vol. 14, (1), p. 19, was followed. These authors effectively described the color of white gold alloys using chroma (C) as the principal measure of whiteness. "Perfect" white has C=O, whereas pure gold has a chroma of about 40. Chroma is a direct measure of departure from perfect white color and is computed from the CIELAB coordinates (see "Standard Test Method for Calculation of Color Differences From Instrumentally Measured Color Coordinates", ASTM Standard D2244-89, Annual Book of ASTM Standards, Vol. 06.01.) as:

$$C=[(a^*)^2+(b^*)^2]^{\frac{1}{2}}$$

Corrosion behavior of selected alloys was tested by the Tuccillo-Nielsen method (see J. J. Tuccillo and J. P. Nielsen, *Journal of Prosthetic Dentistry,* vol. 25, p. 629, 1971) using a "synthetic perspiration" solution consisting of 10% acetic acid and 10% sodium chloride for consisting of 10% acetic acid and 10% sodium chloride for a total of 96 hours. In addition, the same alloys were subjected for 30 minutes in an enclosed container to vapor from concentrated hydrogen sulfide ($H_2S$) solution.

Finally, the sample alloys were investment cast into simple rings using a conventional vacuum-assisted set-up and two alloys were selected for field testing with two different ring manufacturers that utilize the investment casting process.

Table I shows the CIELAB color coordinates and the chroma of several white metals, all of which are commercially available. MacCormack and Bowers, supra., suggested that a good white alloy would have a chroma of less than 9, while an excellent white color would correspond to a chroma below 6. Interestingly, two of the commercial white karat golds have a chroma of about 10; they are in truth slightly yellowish but nevertheless regarded as appealing, soft white.

TABLE I

CIELAB COLOR COORDINATES AND CHROMA OF SEVERAL METALS

| Sample | L* | a* | b* | Chroma |
|---|---|---|---|---|
| Aluminum | 82 | −0.3 | 0.4 | 0.4 |
| Stainless Steel 430 | 77 | 0 | 1.8 | 1.8 |
| Rhodium | 89 | 0.5 | 3.3 | 3.3 |
| Silver | 96 | −0.6 | 3.6 | 3.6 |
| Palladium | 82 | 0.3 | 3.7 | 3.7 |
| Platinum | 80 | 1.6 | 6.8 | 6.9 |
| Nickel | 80 | 0 | 7.4 | 7.4 |
| 10 Kt gold with 17% Ni | 84 | −0.6 | 6.7 | 6.7 |
| 10 Kt gold with 10% Pd | 82 | 0.4 | 10.1 | 10.1 |
| 14 Kt gold with 8.5% Ni | 85 | 1.0 | 10.1 | 10.1 |
| 18 Kt gold with 18% Ni | 84 | −1.4 | 3.6 | 3.9 |

Figure 1B:
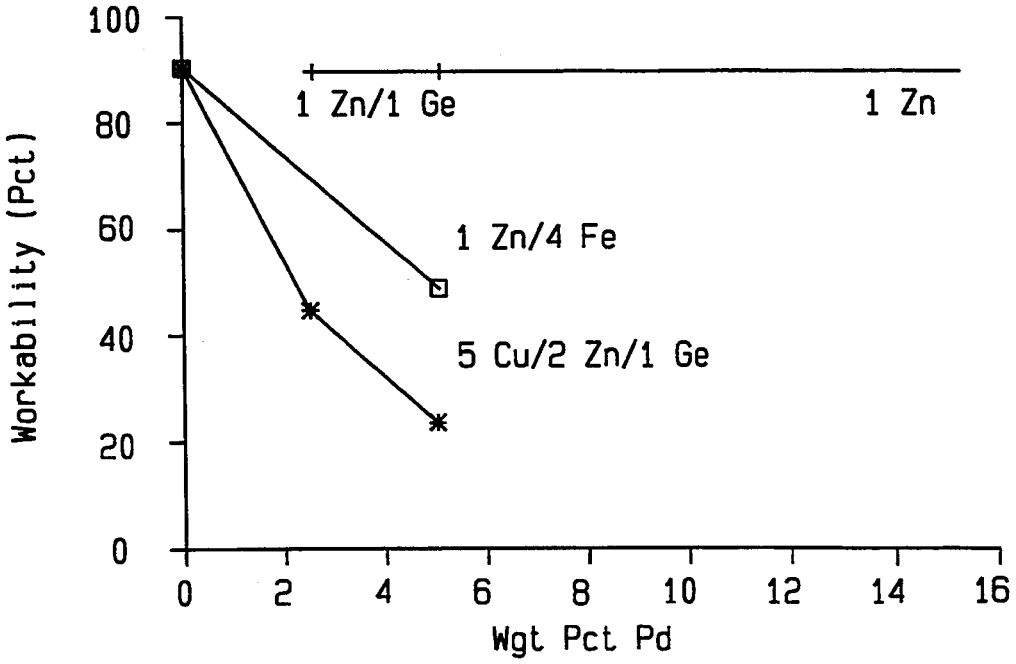
Figure 1C:
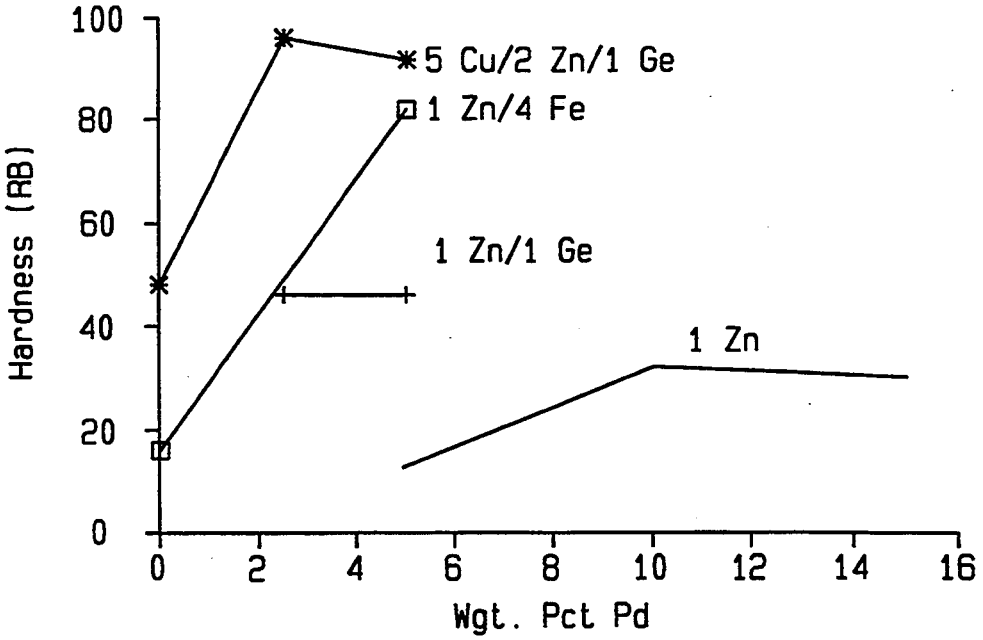
Figure 1D:
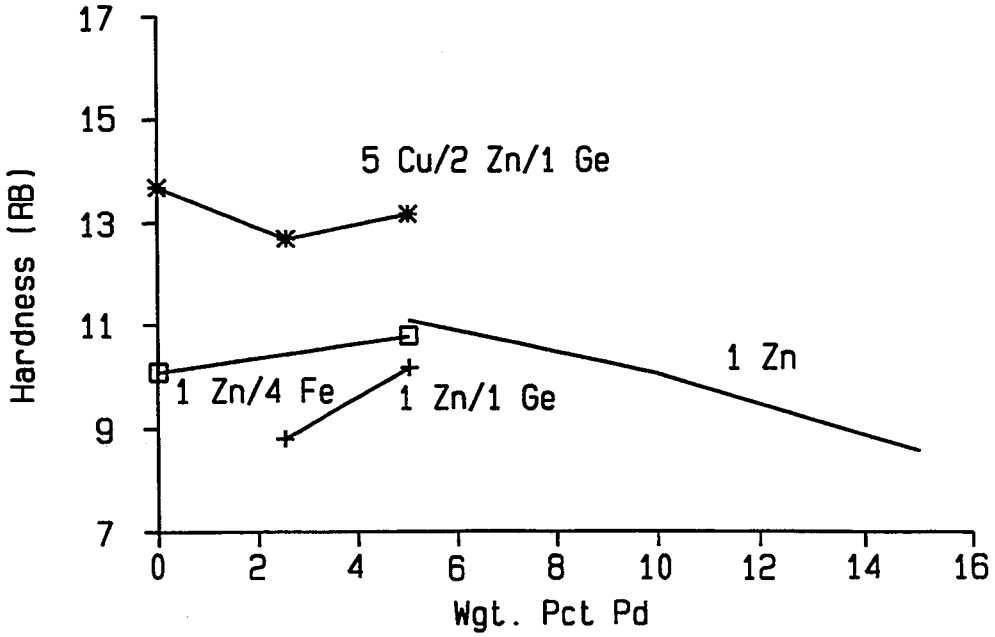
Figure 2A:
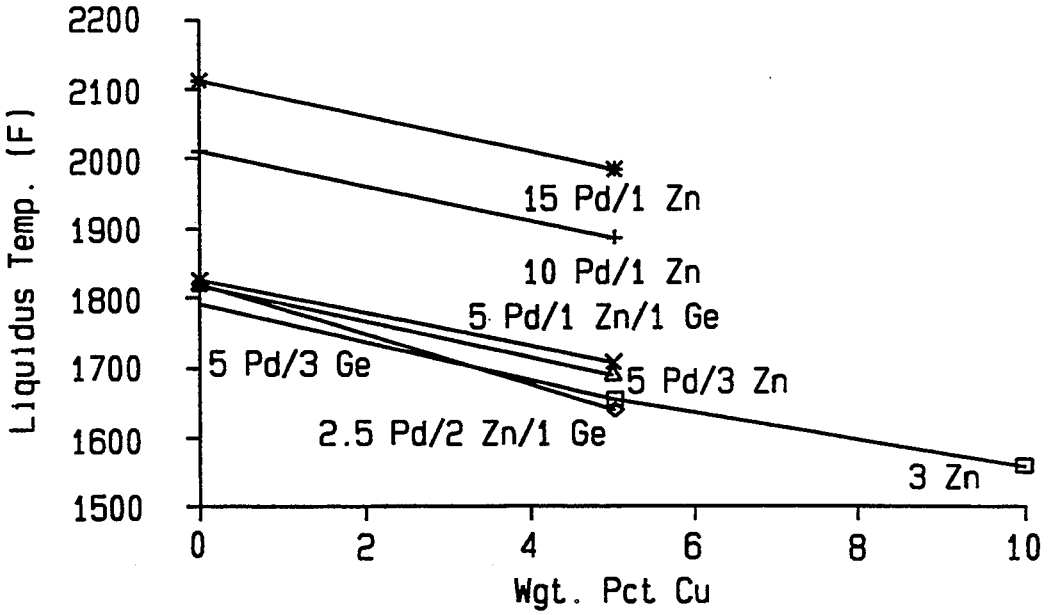
FIGS. 2A, 2B, 2C and 2D illustrate the effect of copper additions on the above-mentioned properties of 10 karat gold alloys.
Figure 2B:
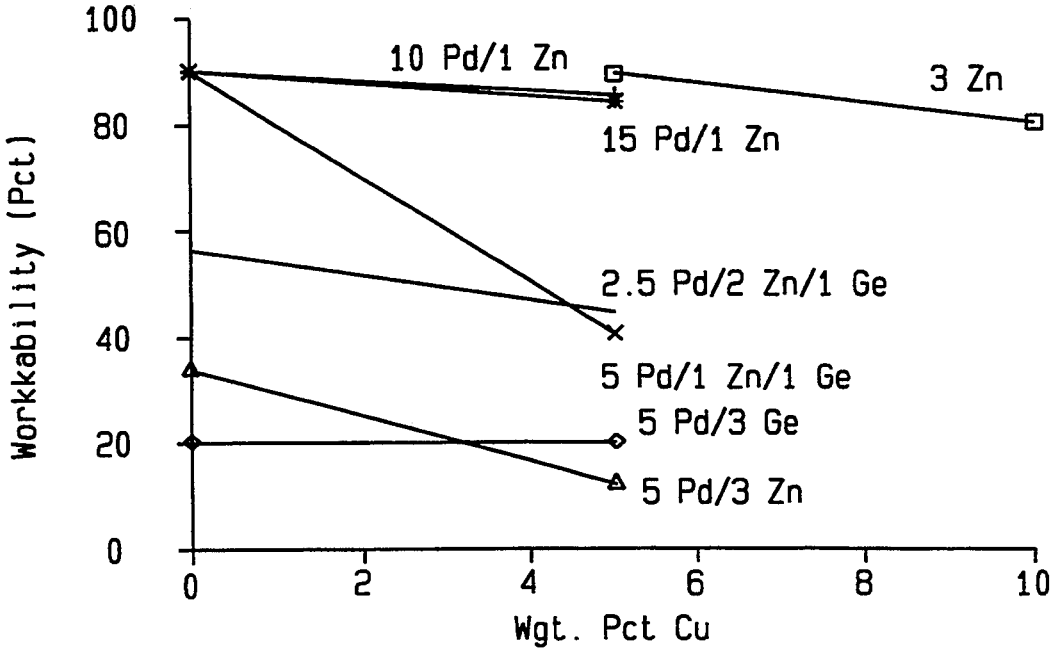
Figure 2C:
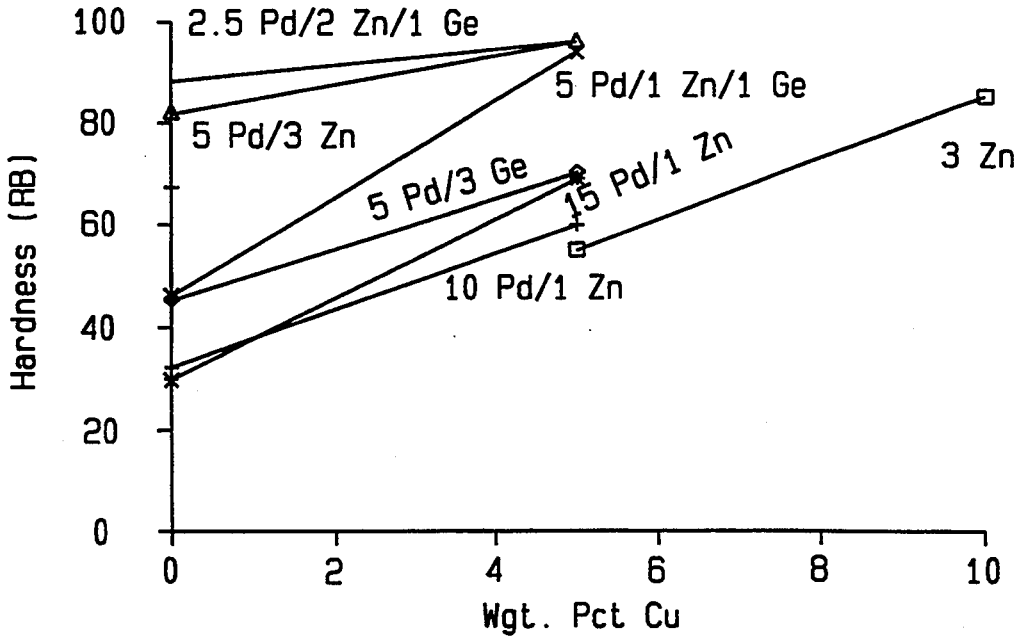
Figure 2D:
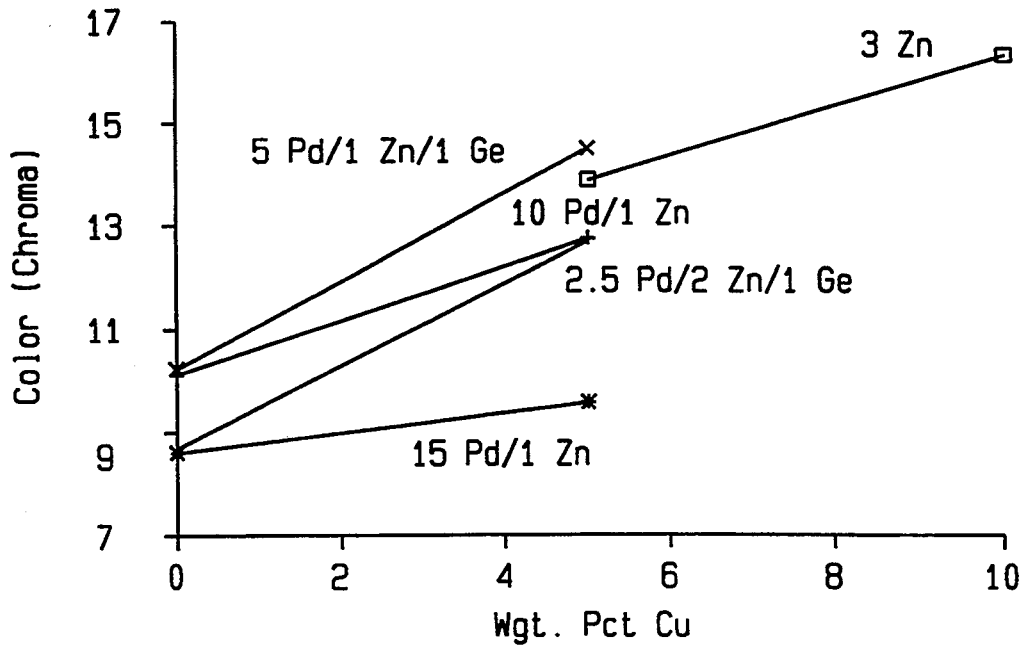
Figure 3A:
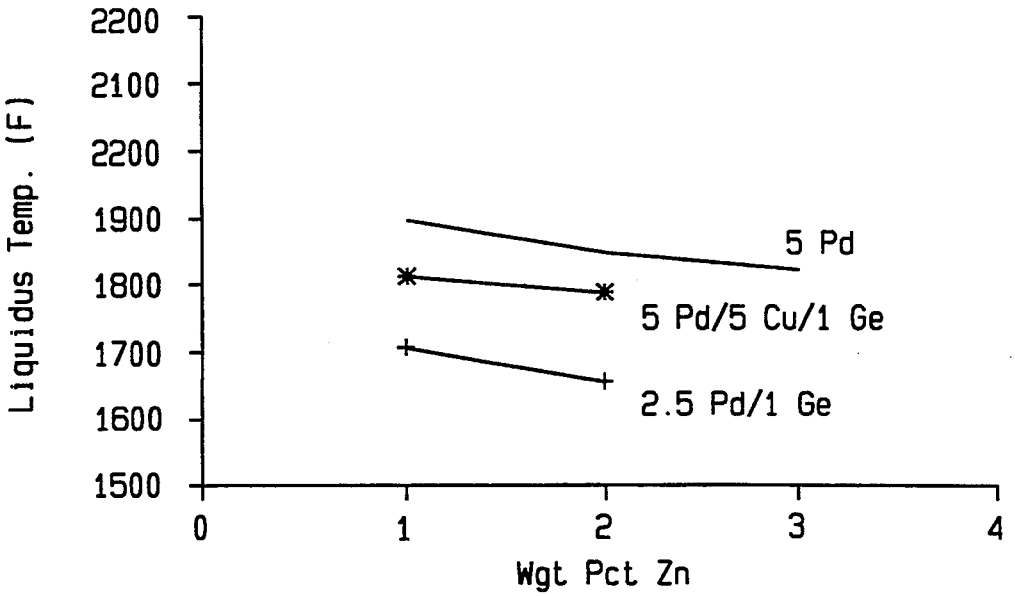
FIGS. 3A, 3B, 3C and 3D illustrate the effect of zinc additions on the above-mentioned properties of 10 karat gold alloys.
Figure 3B:
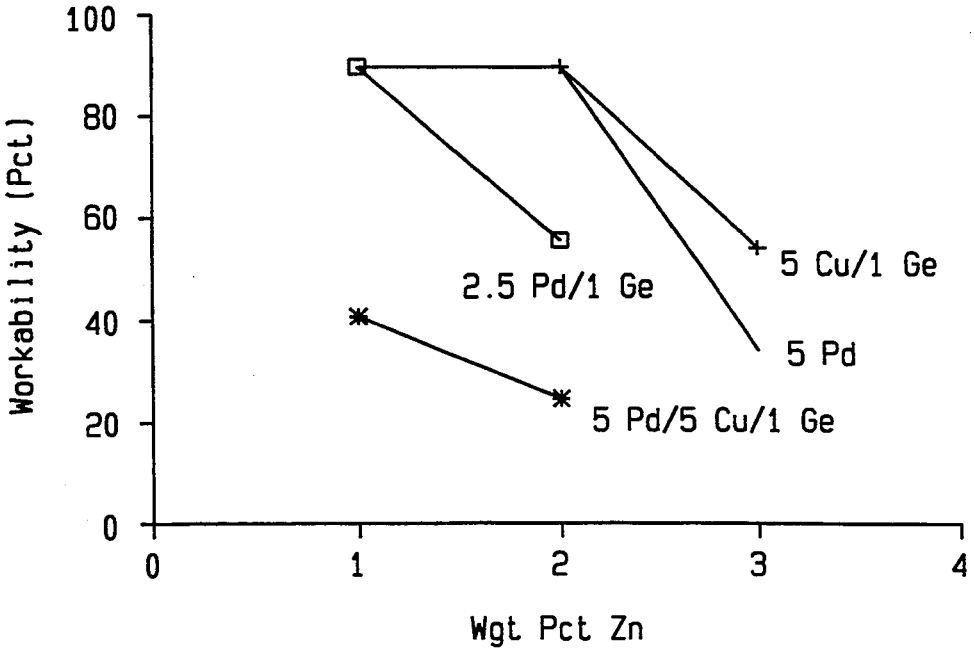
Figure 3C:
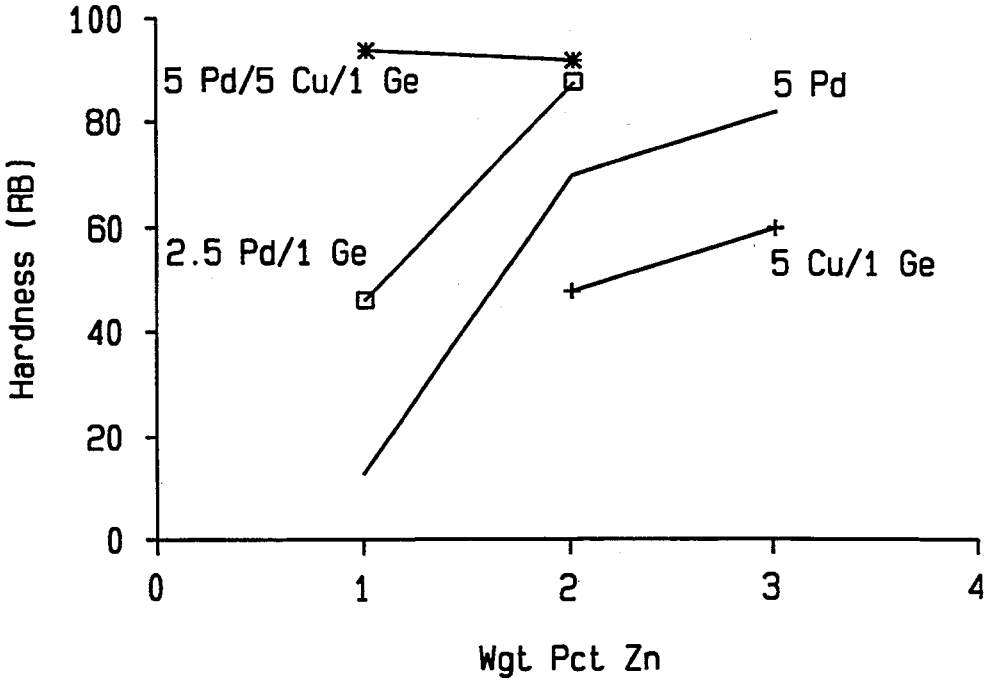
Figure 3D:
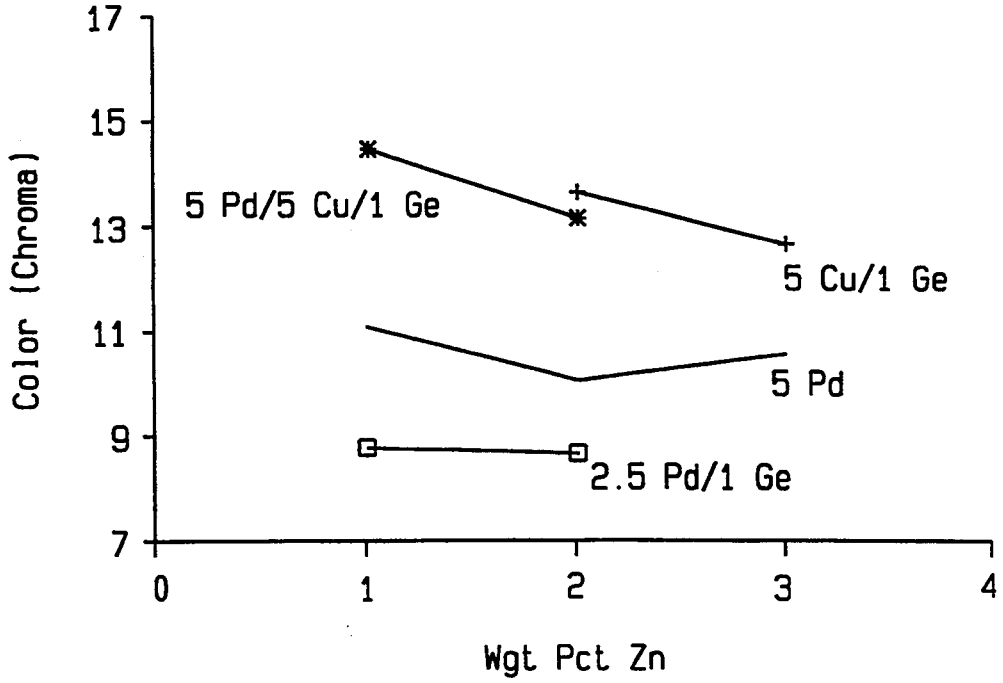
Figure 4A:
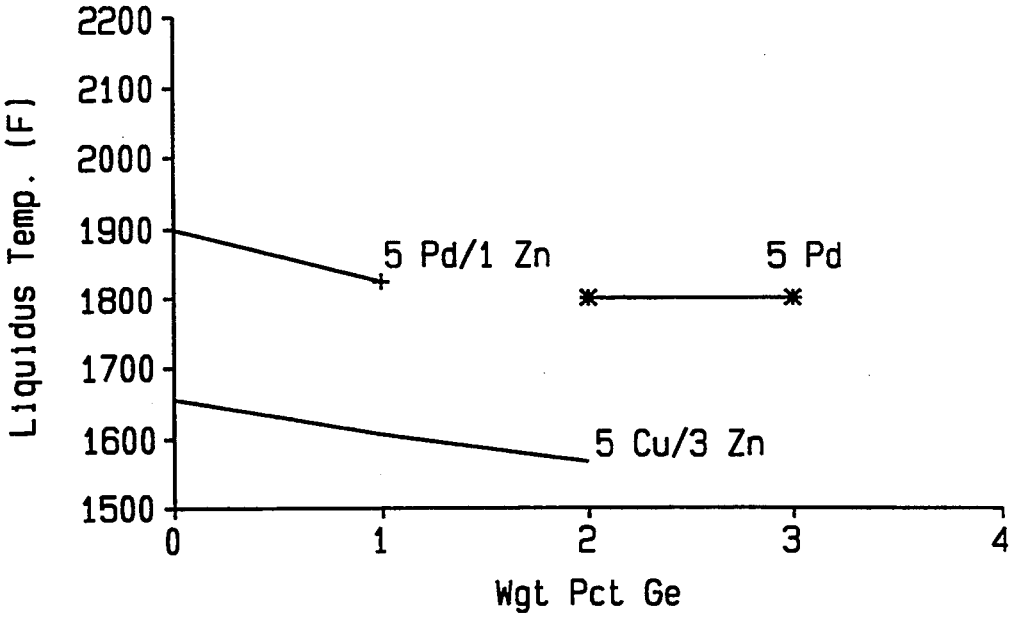
FIGS. 4A, 4B, 4C and 4D illustrate the effect of germanium additions on the above-mentioned properties of 10 karat gold alloys.
Figure 4B:
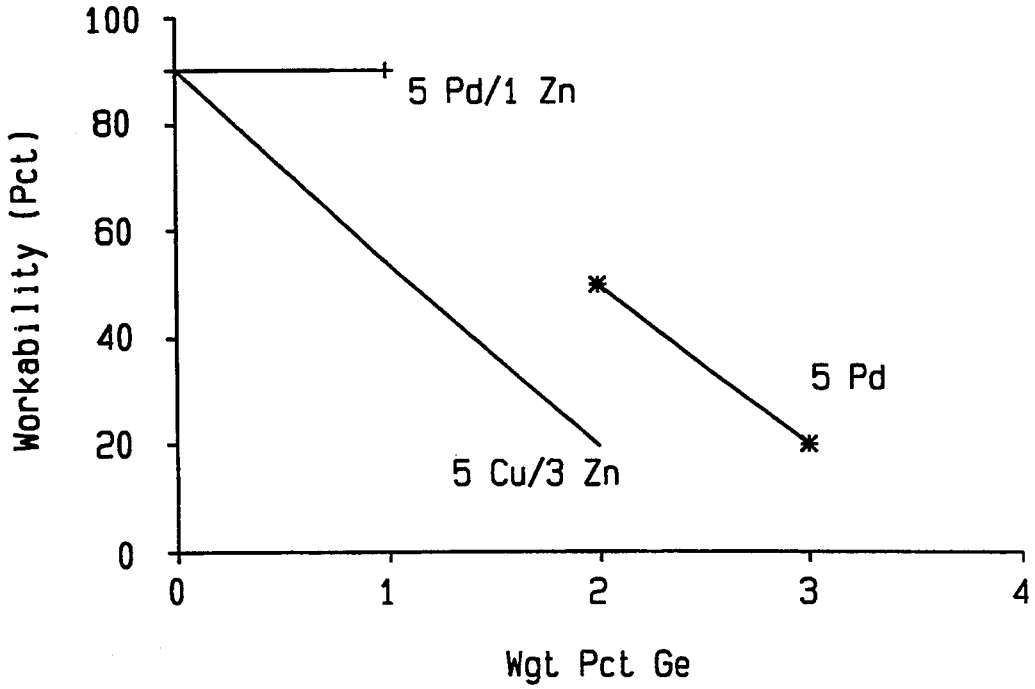
Figure 4C:
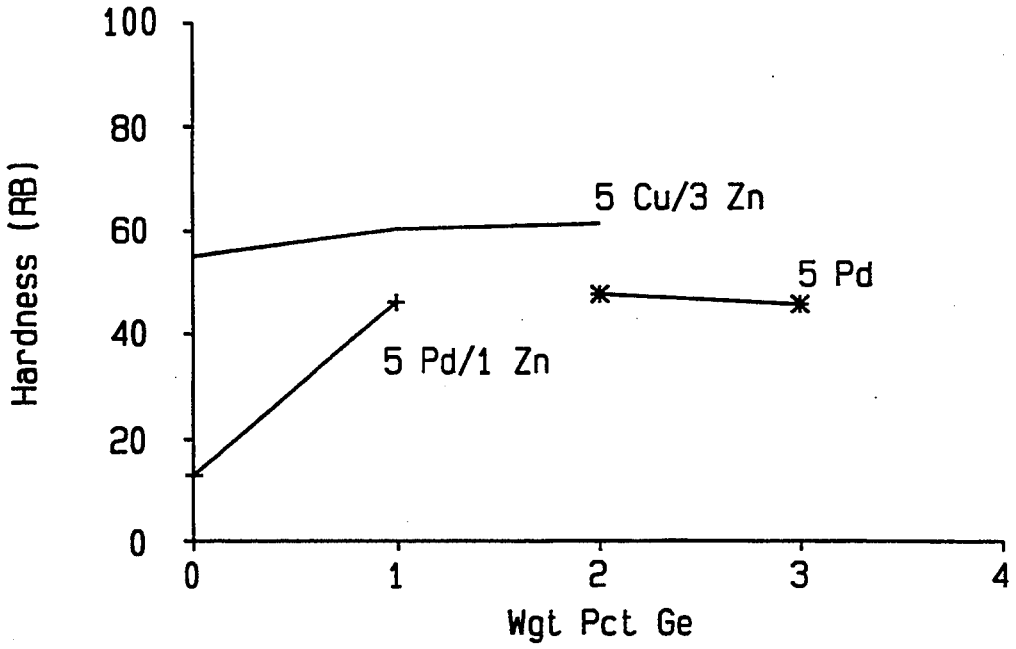
Figure 4D:
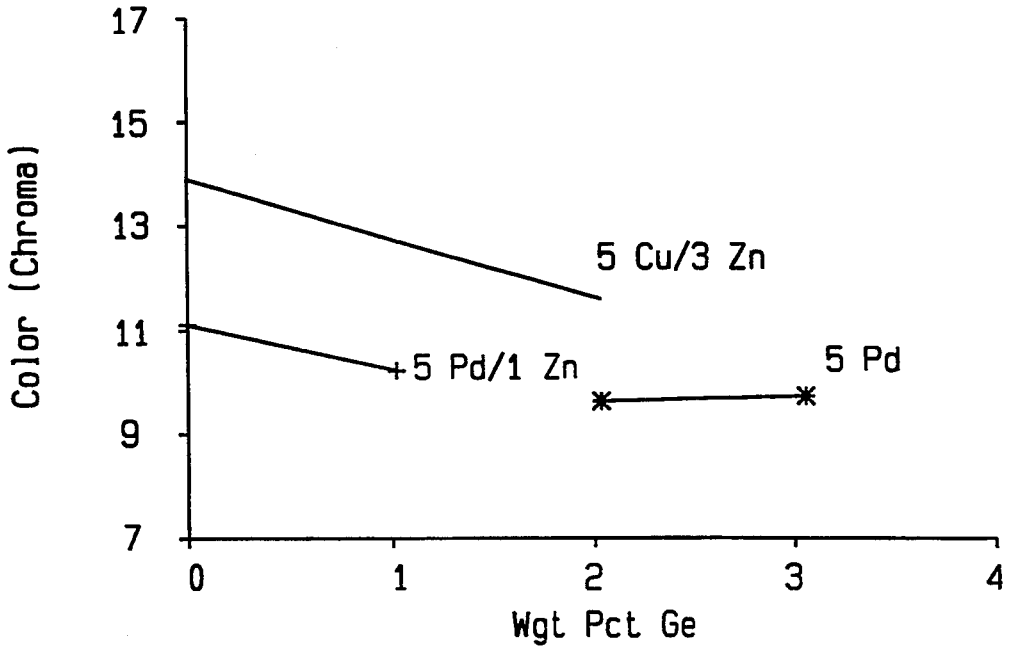
Figure 5A:
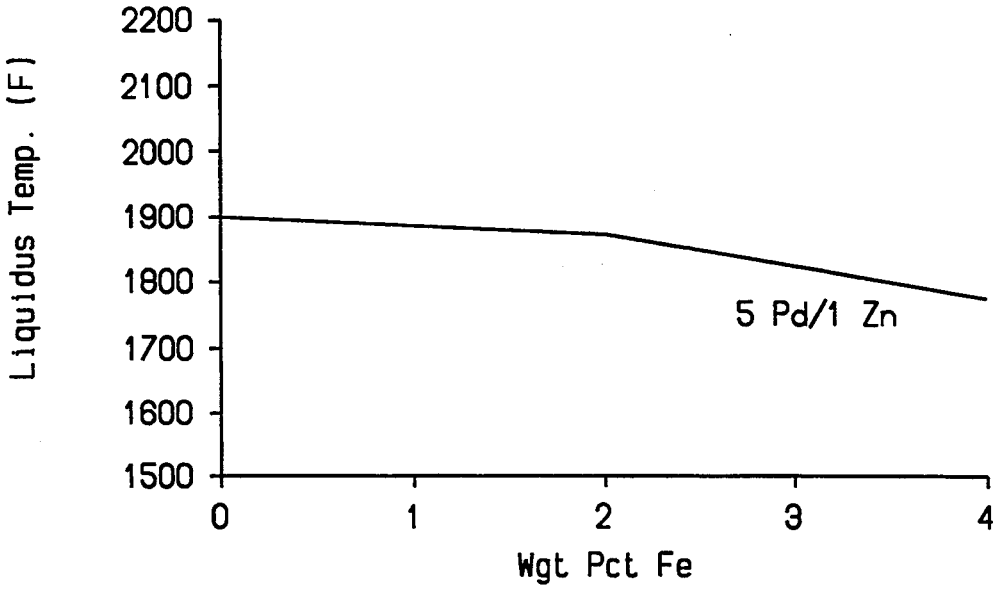
FIGS. 5A, 5B, 5C and 5D illustrate the effect of iron additions on the above-mentioned properties of 10 karat gold alloys.
Figure 5B:
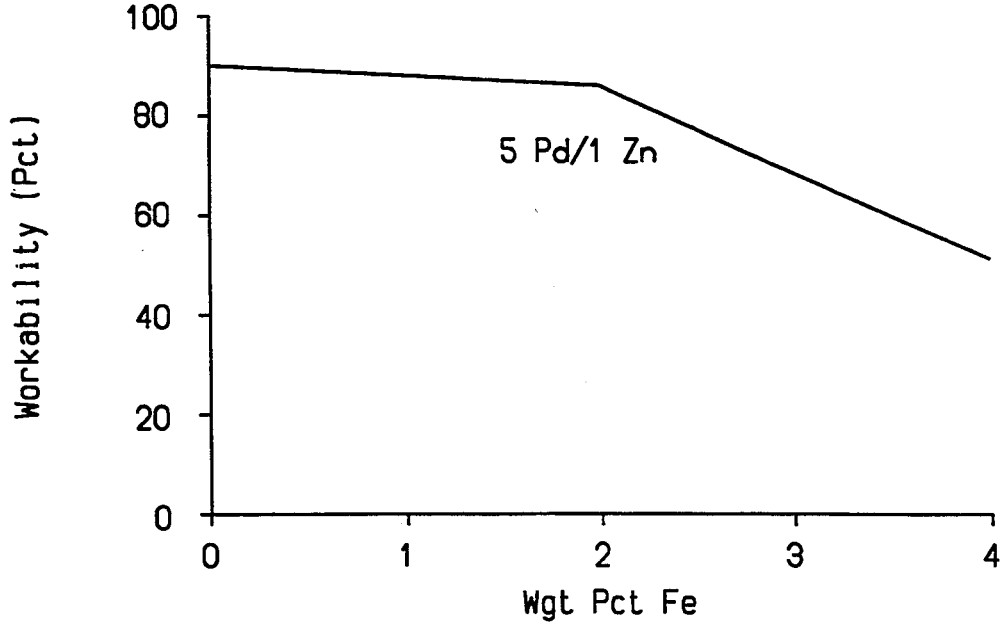
Figure 5C:
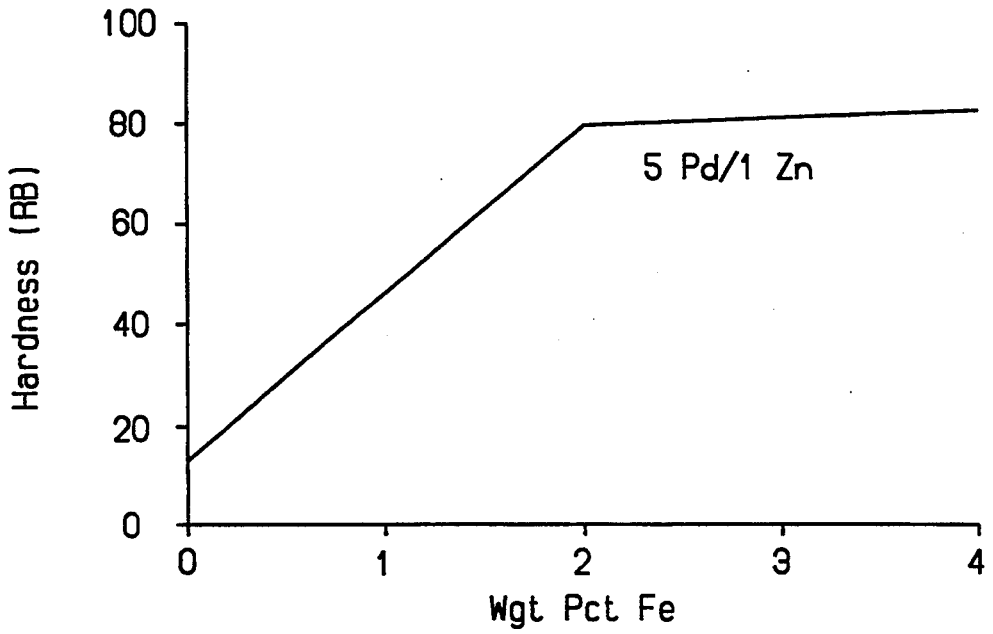
Figure 5D:
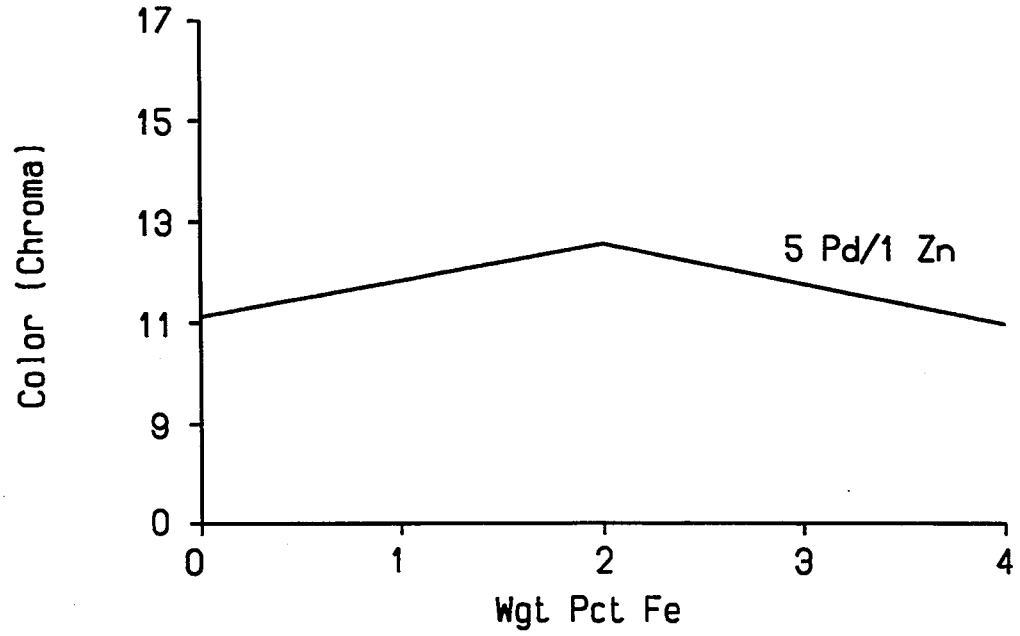

The samples are primarily gold-silver alloys (the major constituents) which have various additions of palladium, copper, zinc, germanium and iron. FIGS. 1 through 5 present the effects of these additions on color, liquidus temperature, hardness and workability of various 10 karat gold alloys. Within each graph, the labels of individual curves indicate the amount of additive in the alloy; the gold content is maintained at 41.7% (10 Kt) and silver constitutes the balance of the alloy. The effects of these elements on the various attributes can be summarized as follows:

a) Hardness

Zinc is a very effective hardener of alloys that also contain small amounts of palladium or copper. Germanium is also a good hardener in alloys that contain palladium. Palladium increases hardness as well, but has only a marginal effect on a "dilute" Au/Ag/1 Zn alloy, where even up to 15% palladium increases hardness only by a small amount. Copper additions consistently increase hardness of all alloys studied. The hardness of gold-silver alloys can be increased more substantially as the result of two or more additives acting in combination.

b) Workability

In general, workability of these alloys follows an inverse relationship to hardness. Zinc additions of 3%, or even 2% in an alloy containing palladium, copper and germanium severely restrict the working characteristics of those alloys. Similar observations apply to germanium for which more than 2% increases the difficult of cold working the alloy. Palladium and copper are not quite as harmful, especially in dilute alloys where additions of 10% or more do not have a significant effect on workability. Small additions of iron do not appear to be detrimental.

c) Liquidus Temperature

Zinc, germanium and copper are the most effective additions in reducing the liquidus temperature. Several alloys have liquidus temperatures of about 1800° F. or below, making them quite attractive for investment casting. Small additions of palladium, up to about 5%, have an insignificant effect on the liquidus temperature, but at levels of 10 to 15%, the liquidus temperature is increased substantially. Iron additions only slightly decrease the liquidus temperature.

d) Color

Zinc and germanium additions up to 3% decrease the chroma. In fact, some zinc and germanium alloys have chromas of about 9 or even below, suggesting their suitability as preferred white gold alloy substitutes. Palladium is a very effective whitener alone, but only at relatively high levels of at least 10 to 15%. Iron additions of up to about 4 weight percent had no noticeable effect. Copper does have a strong colorizing effect, such that amounts above about 2 to 5 weight percent begin to possess a yellow color.

e) Corrosion Resistance

The "synthetic perspiration" test revealed that a commercial 10 Kt white gold alloy containing 17% nickel was the best performer in this test, with a commercial 10 Kt white gold alloy containing 10% palladium a close second. Alloys containing lower palladium levels (i.e, 2.5 and 5%) with zinc and/or germanium were reasonably good, although a small amount of corrosion products were observed on the surface. The iron containing alloys were found to be the most susceptible to corrosion.

The $H_2S$ vapor exposure produced somewhat different results. The nickel bearing alloy was badly tarnished within 10 minutes and the iron containing alloys were visibly tarnished as well. The group of alloys with 2.5 and 5 % palladium with zinc and/or germanium showed just a slight tarnish after 30 minutes, which was almost as good as the commercial 10% palladium alloy.

f) Investment Casting

Simple casting tests demonstrated good casting characteristics in all alloys. In particular, the gold-silver-palladium-germanium were alloys were very clean upon melting, with virtually no dross or slag being evident on the melt surface. This is possibly due to the fact that germanium, while an effective melt deoxidizer, forms an oxide which has a sublimation temperature of only 710° C. (1310° F.). Thus, as soon as germanium oxide forms by melt deoxidation or by reaction of germanium with any oxygen over the melt surface, the oxide escapes as harmless gas. In addition, the surfaces of the cast buttons of these alloys were very clean.

Based on the test results, those alloys which are non-allergenic, have reasonably low casting temperatures, good workability, adequate hardness, good corrosion resistance, and are affordable, were selected as preferred white gold alloy substitutes. Table II lists five such alloys, coded A, B, C, D and E. For comparison, two commercial 10 Karat alloys were included, one is a nickel containing alloy, and the other a palladium containing alloy. Also included in this table are alloys F and G; which have low liquidus temperatures and are of value as 10 Kt solders. Note that alloy F is very hard and also workable, but the color is somewhat off-white. Alloy G would offer a perfect color match, although it is very soft, which may be desirable for certain applications.

Alloys A through E exhibit remarkably good properties. All are white in color, are workable and have reasonably low casting temperatures. They contain either 2.5 or 5% palladium, which is much less than commercial palladium containing white gold alloys. Ascast hardnesses are significantly superior to the commercial palladium containing white gold alloys and, depending on the amounts of palladium, zinc and germanium, hardnesses can approach those of commercial nickel containing white gold alloys.

Alloys D and E were chosen for field testing. Results from these trials are summarized as follows:

Field Test A

The following test conditions were utilized:

| | |
|---|---|
| Metal Temperature | = 1070° C. (1960° F.) |
| Flask Temperature | 675° C. (1250° F.) |
| Investment Type | = Kerr Satin Cast 20 |
| Casting Machine | = Memco, Vacuum Assisted |
| Melt Cover | = 60 $H_2$/40 $N_2$ gas mixture |

Styles with prongs were selected to observe the behavior in the setting process and tumbling process. At this site, nickel containing white gold alloys often break during the tumbling or stone setting processes. Both alloys D and E produced good cast pieces, but alloy E proved superior in terms of casting rejects and surface oxidation. Both alloys behaved well in finishing operations such as grinding, tumbling, reducing atmosphere brazing, polishing and stone settings.

Field Test D

The following test conditions were utilized:

| | |
|---|---|
| Metal Temperature | = 1105° C. (2020° F.) |
| Flask Temperatures | = 495° C. (920° F.) and 730° C. (1350° F.) |
| Investment Type | = Whip Mix Jewelry |
| Casting Machine | = Jelrus, Electric Resistance, Vacuum Assisted |

Both alloys filled very well into the 1350° F. flask, but the 920° F. flask did not fill completely, an indication that the latter temperature was too low. The castings cleaned up easily with bead blasting. At this test facility, the standard finishing methods are effective with castings that have a Rockwell Hardness B of above about 70. Alloy D was marginal in this respect while alloy E was too soft. It is most likely that alloy A would work well at this site since it has similar good casting characteristics and enhanced hardness.

TABLE II

COMPARISON OF NEW WHITE GOLD ALLOYS WITH COMMERCIAL NICKEL AND PALLADIUM CONTAINING ALLOYS

| | COMPOSITION, wt. pct. | | | | | | LIQUIDUS | HARDNESS | WORK | | | | |
|---|---|---|---|---|---|---|---|---|---|---|---|---|---|
| ALLOY | Au | Pd | Ag | Cu | Zn | Ge | (°F.) | (RB) | (%) | L* | a* | b* | CHROMA |
| 10 Kt (Ni) | 41.7 | — | — | 33 | 8.3 | (17 Ni) | 1945 | 84 | 90 | 84 | −0.6 | 6.7 | 6.7 |
| 10 Kt (Pd) | 41.7 | 10 | 47.3 | — | 1 | — | 2010 | 32 | 90 | 82 | 0.4 | 10.1 | 10.1 |
| A | 41.7 | 2.5 | 52.8 | — | 2 | 1 | 1790 | 88 | 56 | 91 | −1.3 | 8.6 | 8.7 |
| B | 41.7 | 2.5 | 53.8 | — | 1 | 1 | 1815 | 46 | 90 | 92 | −1.6 | 8.6 | 8.8 |
| C | 41.7 | 5 | 51.3 | — | 1 | 1 | 1825 | 46 | 90 | 88 | −1.4 | 10.1 | 10.2 |
| D | 41.7 | 5 | 51.3 | — | 2 | — | 1850 | 70 | 90 | 88 | −0.5 | 10.1 | 10.1 |
| E | 41.7 | 5 | 51.3 | — | — | 2 | 1800 | 47 | 60 | 89 | −1.9 | 9.5 | 9.6 |
| F | 41.7 | — | 45.3 | 10 | 3 | — | 1565 | 85 | 81 | 93 | −3.8 | 15.8 | 16.3 |
| G | 41.7 | — | 52.3 | — | 6 | — | 1655 | 0 | 90 | 92 | −1.8 | 8.8 | 8.9 |

The alloys which contain substantial amounts of iron or copper are not preferred for use in the present invention. The iron containing alloys are relatively sluggish in casting and performed less satisfactorily in the corrosion resistance tests, probably due to the relatively lower solubility of iron in the gold-silver alloy compared to the other components. While copper did impart certain beneficial attributes to these alloys, such as increased hardness, it has a relatively strong colorizing effect, so that significant amounts cannot be included when alloys having white colors are desired.

Although the objective of the invention is to produce a substantially nickel-free white gold alloy, it is of course recognized that trace amounts of nickel can be added to the alloys described above without affecting the characteristics and performance of these alloys. The preferred alloys will be completely free of nickel, but the inclusion of trace or residual amounts can be tolerated, provided that such amounts maintain the formulation to be non-allergenic.

While it is apparent that the invention herein disclosed is well calculated to fulfill the objects above stated, it is well appreciated that numerous modifications and embodiments may be devised by those skilled in the art. For example, in light of the present disclosure, those skilled in the art can develop variations as to the types and amounts of whitening agents depending upon the desired color of the final alloy. This, of course, would depend upon the use of the alloy, with the color of solders or braze materials being less significant than for the alloys which are to be used as white gold castings and which would require a white color (i.e., a chroma or about 10 or below). It is intended, therefore, that the appended claims cover all such modifications and embodiments as fall within the true spirit and scope of the present invention.

What is claimed is:

1. A white gold alloy composition consisting essentially of about 35 to 50 weight percent of gold, about 35 to 63 weight percent of silver, about 0.1 to 7 weight percent of a whitening component of zinc, germanium or both, and palladium in an amount of 5 weight percent or less, wherein the whitening component and the palladium are present in an amount sufficient to impart a white gold appearance and a liquidus temperature of no greater than about 1950° F. to the alloy.

2. The white gold alloy composition of claim 1 wherein the whitening component and the palladium are present in an amount sufficient to impart a liquidus temperature of between about 1700° and 1900° F. to the alloy.

3. The white gold alloy composition of claim 1 wherein the amount of gold is about 38 to 45 weight percent.

4. The white gold alloy composition of claim 1 wherein the amount of silver is about 46 to 60 weight percent.

5. The white gold alloy composition of claim 1 wherein the amount of palladium is 2 to 5 weight percent.

6. The white gold alloy composition of claim 1 wherein the amount of the whitening component is about 0.5 to 6 weight percent.

7. The white gold alloy composition of claim 6 wherein the whitening component is zinc and is present in an amount of about 4 weight percent or less.

8. The white gold alloy composition of claim 6 wherein the whitening component is germanium and is present in an amount of about 4 weight percent or less.

9. The white gold alloy composition of claim 6 wherein the whitening component is zinc and germanium, each of which is present in an amount of about 0.5 to 2.5 weight percent.

10. A white gold alloy composition consisting essentially of about 38 to 45 weight percent of gold, about 46 to 60 weight percent of silver, about 0.1 to 7 weight percent of a whitening component of zinc, germanium or both, and palladium in an amount of about 2 to 5.5 weight percent, wherein the whitening component and the palladium are present in an amount sufficient to impart a white gold appearance and a liquidus temperature of between about 1700° and 1900° F. to the alloy.

11. The white gold alloy composition of claim 10 wherein the liquidus temperature is between about 1700° and 1850° F.

12. The white gold alloy composition of claim 10 wherein the amount of the whitening component is about 0.5 to 6 weight percent.

13. The white gold alloy composition of claim 10 wherein the whitening component is zinc and is present in an amount of about 4 weight percent or less.

14. The white gold alloy composition of claim 10 wherein the whitening component is germanium and is present in an amount of about 4 weight percent or less.

15. The white gold alloy composition of claim 10 wherein the whitening component is zinc and germanium, each of which is present in an amount of about 0.5 to 2.5 weight percent.

16. A white gold alloy composition consisting essentially of about 40 to 43 weight percent of gold, about 50 to 55 weight percent of silver, about 0.1 to 7 weight percent of a whitening component of zinc, germanium or both, and palladium in an amount of about 2 to 5 weight percent, wherein the whitening component and the palladium are present in an amount sufficient to impart a white gold appearance and a liquidus temperature of between about 1700° and 1850° F. to the alloy.

17. The white gold alloy composition of claim 16 wherein the amount of the whitening component is about 0.5 to 6 weight percent.

18. The white gold alloy composition of claim 16 wherein the whitening component is zinc and is present in an amount of about 4 weight percent or less.

19. The white gold alloy composition of claim 16 wherein the whitening component is germanium and is present in an amount of about 4 weight percent or less.

20. The white gold alloy composition of claim 16 wherein the whitening component is zinc and germanium, each of which is present in an amount of about 0.5 to 2.5 weight percent.

* * * * *